US009364136B2

(12) United States Patent
Devir

(10) Patent No.: US 9,364,136 B2
(45) Date of Patent: Jun. 14, 2016

(54) POLE CLEANING APPARATUS

(71) Applicant: Cherie Devir, Carmel, IN (US)

(72) Inventor: Cherie Devir, Carmel, IN (US)

(73) Assignee: Cherie Devir, Carmel, IN (US)

( * ) Notice: Subject to any disclaimer, the term of this patent is extended or adjusted under 35 U.S.C. 154(b) by 0 days.

(21) Appl. No.: 14/333,546

(22) Filed: Jul. 17, 2014

(65) Prior Publication Data

US 2015/0020331 A1 Jan. 22, 2015

Related U.S. Application Data

(60) Provisional application No. 61/856,849, filed on Jul. 22, 2013.

(51) Int. Cl.

| | |
|---|---|
| ***B08B 9/023*** | (2006.01) |
| ***A47L 25/00*** | (2006.01) |
| ***B25G 3/02*** | (2006.01) |
| ***B25G 3/38*** | (2006.01) |
| ***B25G 1/04*** | (2006.01) |
| ***A47L 13/10*** | (2006.01) |

(52) U.S. Cl.

CPC ..... *A47L 25/00* (2013.01); *A47L 13/10* (2013.01); *B25G 1/04* (2013.01); *B25G 3/02* (2013.01); *B25G 3/38* (2013.01); *B08B 9/023* (2013.01)

(58) Field of Classification Search

CPC ..... B08B 9/023; B08B 9/02; A47L 25/00
USPC ..... 15/104.04
See application file for complete search history.

(56) References Cited

U.S. PATENT DOCUMENTS

| | | | | |
|---|---|---|---|---|
| 4,375,115 | A * | 3/1983 | Zimmerman | 15/160 |
| 5,437,138 | A * | 8/1995 | Tuohey | E04D 13/064 248/48.2 |
| 6,526,619 | B1 * | 3/2003 | Cassels, Jr. | 15/236.04 |
| 2004/0064909 | A1 * | 4/2004 | Locklear | 15/160 |

* cited by examiner

*Primary Examiner* — Laura C Guidotti
(74) *Attorney, Agent, or Firm* — Woodard, Emhardt, Moriarty, McNett & Henry LLP

(57) ABSTRACT

A pole cleaning apparatus comprises an elongate handle portion engaged with a cleaning head. In certain embodiments, the cleaning head has a width shaped as a partial-tubular member and an opening extending along the longitudinal axis through which a pole is passed to engage the cleaning head with the pole to be cleaned. The cleaning head may include an inner arcuate surface configured to at least partially surround the pole. The apparatus also includes a mounting assembly designed to pivotably engage the cleaning head to the handle portion such that the handle portion is pivotable with respect to the cleaning head in at least one plane containing the longitudinal axis. Optionally, the apparatus may include a cleaning pad selectively engageable with the cleaning head.

19 Claims, 6 Drawing Sheets

POLE CLEANING APPARATUS

CROSS-REFERENCE TO RELATED APPLICATIONS

This application claims the benefit of U.S. Provisional Patent Application No. 61/856,849, filed Jul. 22, 2013, which is hereby incorporated by reference.

FIELD OF THE DISCLOSURE

The present disclosure relates generally to the field of cleaning devices, and more specifically provides a pole cleaning apparatus with a pivoting arcuate cleaning head.

BACKGROUND OF THE DISCLOSURE

It is often desirable to clean and polish poles and other cylindrical objects, such as decorative poles and vertical fitness poles, as such objects can accumulate dirt, dust, wax, oil, etc. Cleaning and polishing poles by hand can be a difficult, tedious and time-consuming task. Relatively tall vertical poles can be especially difficult to conveniently reach to clean. Some prior art devices have been developed to aid in particular aspects of pole cleaning. However, many of these devices are limited in adjustability, do not allow for great height reach, are not convenient to use, are not sturdy and durable, and/or do not allow for ease of storage and transport. The present disclosure is directed to addressing these limitations and others.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles of the disclosure being contemplated as would normally occur to one skilled in the art to which the disclosure relates.

In certain embodiments, the present disclosure provides a pivotable pole cleaning apparatus with an arcuate cleaning head. The arcuate cleaning head may be engaged with an elongate handle to enable use of the device on poles at heights above the user's reach. The apparatus may optionally be used with removable cleaning pads which are selectively and removably engageable with the arcuate cleaning head to assist in the cleaning process.

Figure 9:
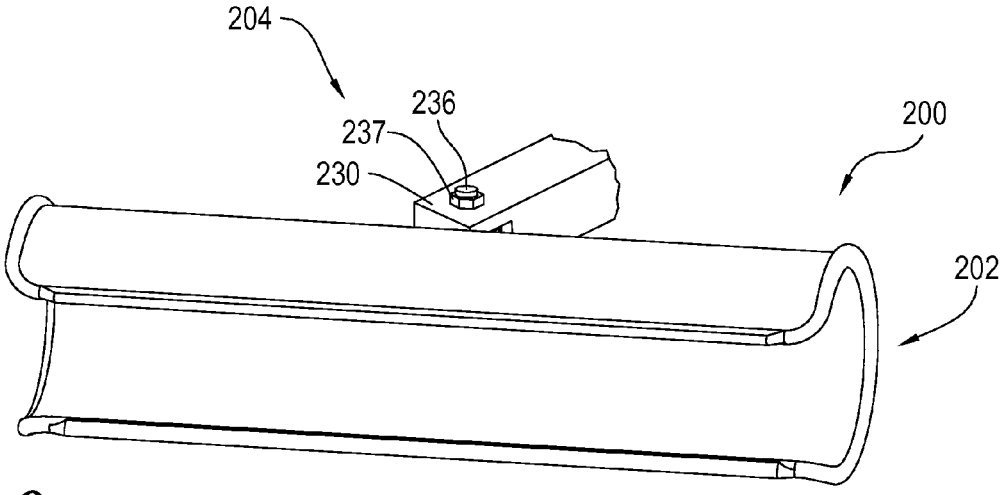
FIG. 9 is a perspective view of a pole cleaning apparatus according to another embodiment of the present disclosure.
Figure 10:
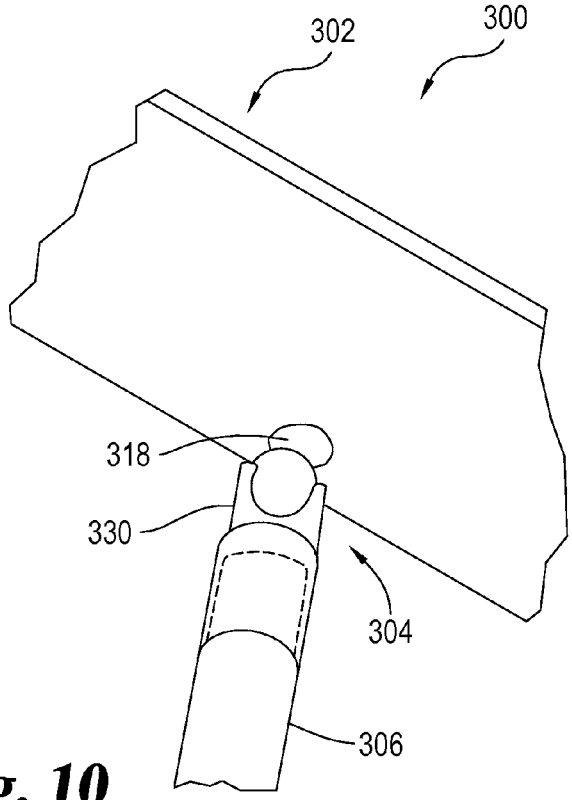
FIG. 10 is a perspective view of a pole cleaning apparatus according to another embodiment of the present disclosure.

Illustrated in the figures are various views and embodiments of pole cleaning apparatuses. Specifically, FIGS. 1-8 and 11 show various views of a pole cleaning apparatus 100 (and specific example components thereof) according to an embodiment of the present disclosure. FIGS. 9 and 10 show additional embodiments of pole cleaning apparatuses contemplated by the present disclosure. FIG. 12 shows an embodiment of a pole cleaning apparatus having optional features contemplated by the present disclosure.

Turning to FIGS. 1-8, there is shown a pole cleaning apparatus 100 having an arcuate cleaning head 102 and an elongate handle 106 connected to the head 102 via a pivot joint such as the illustrated mounting assembly 104. The cleaning head 102 includes an open, partial-tubular member 110 of generally cylindrical shape having an internal diameter width W approximate the diameter of the pole to be cleaned. In preferred embodiments, the tubular member 110 is configured to snugly clamp around the circumference of the pole to be cleaned. In the particular illustrated embodiment, the partial-tubular member 110 spans an arc of approximately 275 degrees, leaving an opening of approximately 85 degrees. However, it should be appreciated that the arcuate span of the tubular member can be of greater or lesser degrees. Additionally, the tubular member 110 includes a length L of sufficient distance to provide for a substantial cleaning surface area to reduce cleaning time and improve efficiency.

The tubular member 110 defines an inner arcuate contact surface 112 and an opening 114 for passage of the pole during initial positioning or removal of the apparatus. In the illustrated embodiment, the arcuate surface 112 includes spaced-apart parallel edges defining the opening 114. In optional embodiments, the length edges may be flared along length L to assist in placement on a pole, as illustrated. Additionally, it is contemplated that all edges may be flared in other embodiments, including the edges extending along the width W. The tubular member 110 may be substantially rigid or may be at least slightly flexible to allow for deflection of the sides or edges of member 110 as the pole is passed through the opening 114 during initial positioning. Once the pole has passed through opening 114 and is positioned against surface 112, the member 110 is biased to elastically return to its non-deflected position to surround a portion of the circumference of the pole.

In optional embodiments, the cleaning head 102 may include a selective locking mechanism designed to retain the tubular member 110 against the pole to be cleaned. As examples, the optional locking mechanism may be tabs, hook and loop fasteners, straps, ties, latches or other appropriate selective locking mechanisms. To illustrate one non-limiting example, FIG. 12 shows straps 480 extending from the tubular member 110 which can be secured together about the pole to retain the tubular member 110 against the pole during cleaning.

In alternative embodiments, the tubular member may be formed in a hinged clamp or clamshell arrangement to encircle a portion or all of the pole circumference along the length of the tubular member. For example, the clamshell arrangement may consist of two movable pieces pivotable about a pin to open and close together. The clamp or clamshell design may be spring-loaded to bias the tubular member toward a closed position.

Figure 1:
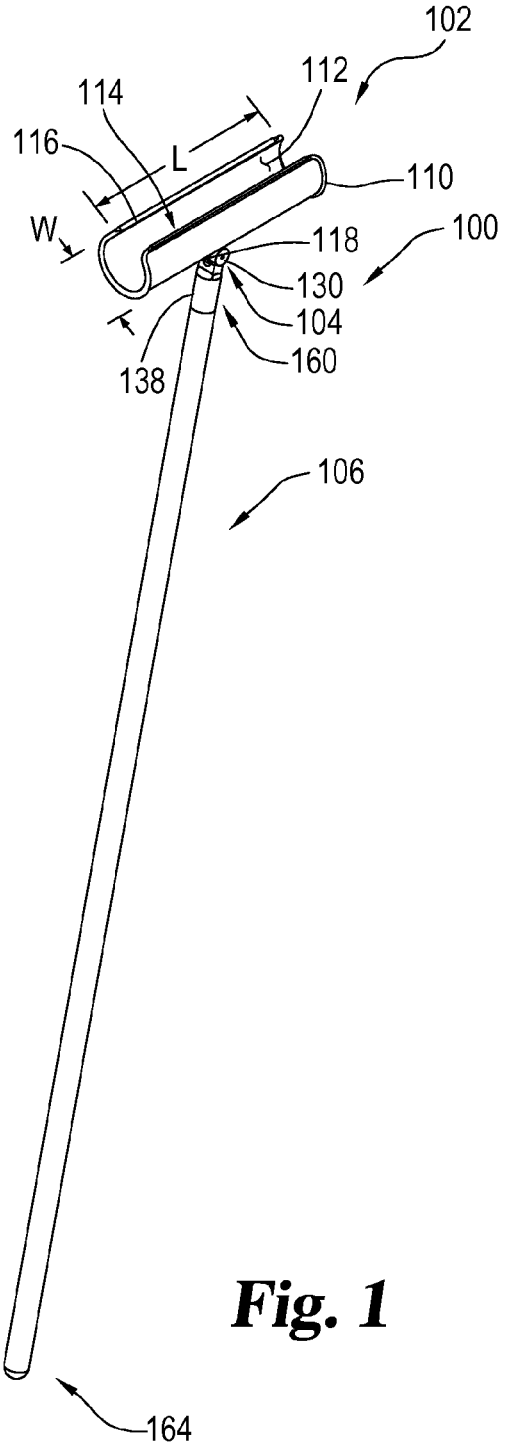
FIG. 1 is a perspective view of a pole cleaning apparatus according to an embodiment of the present disclosure.
Figure 2:
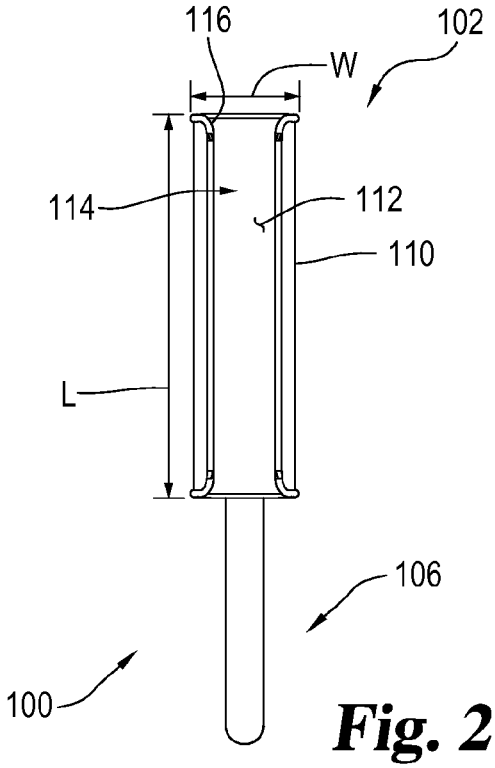
FIG. 2 is a top view of the pole cleaning apparatus of FIG. 1.
Figure 3:
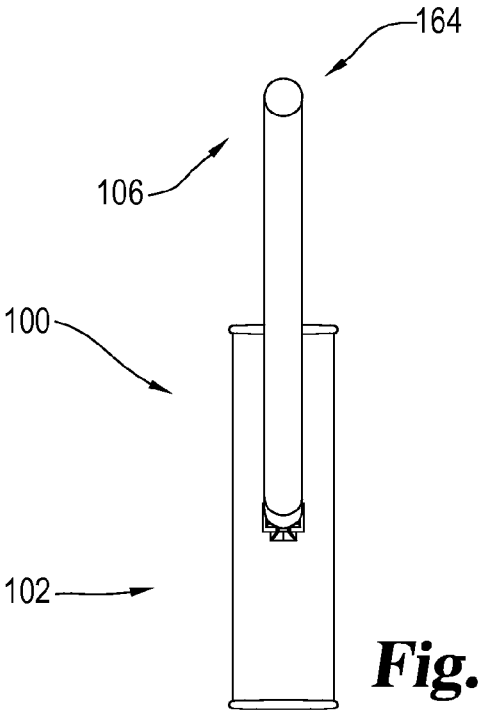
FIG. 3 is a bottom view of the pole cleaning apparatus of FIG. 1.
Figure 4:
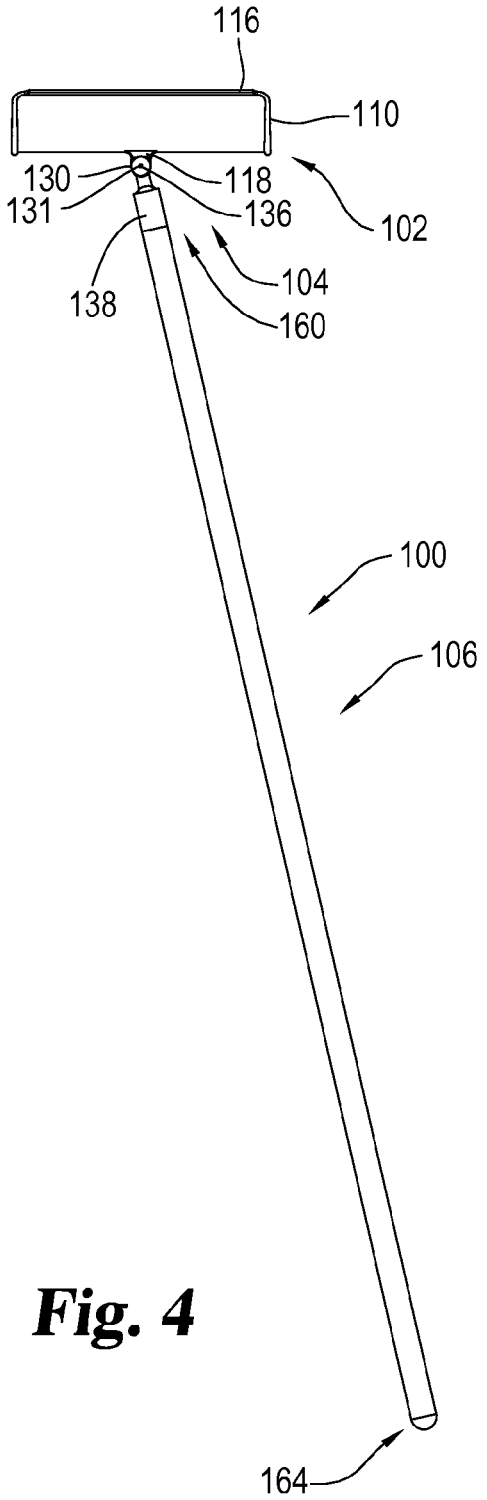
FIG. 4 is a side view of the pole cleaning apparatus of FIG. 1.
Figure 5:
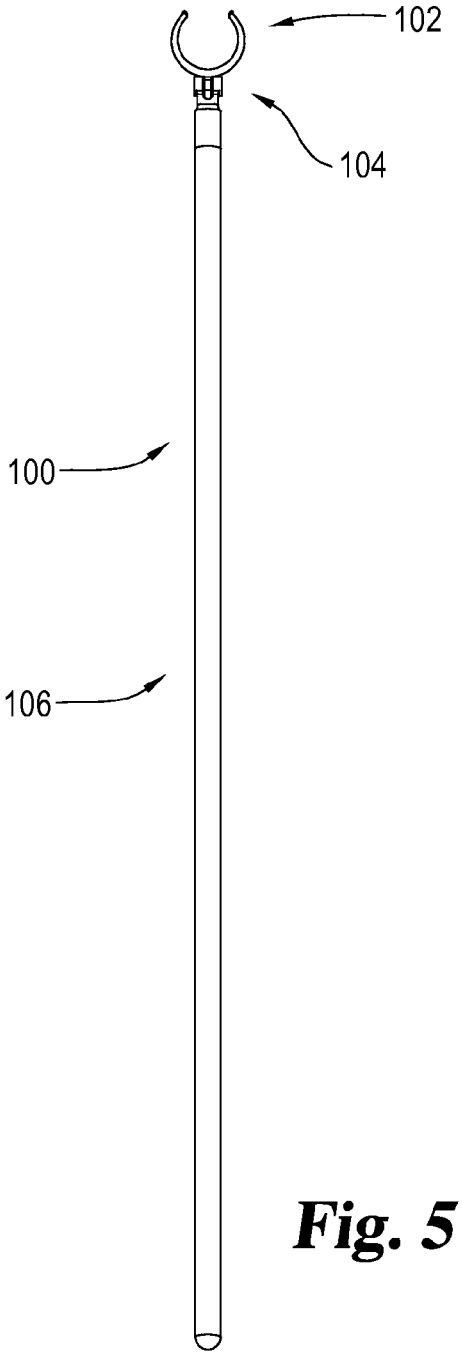
FIG. 5 is an end view of the pole cleaning apparatus of FIG. 1.
Figure 7:
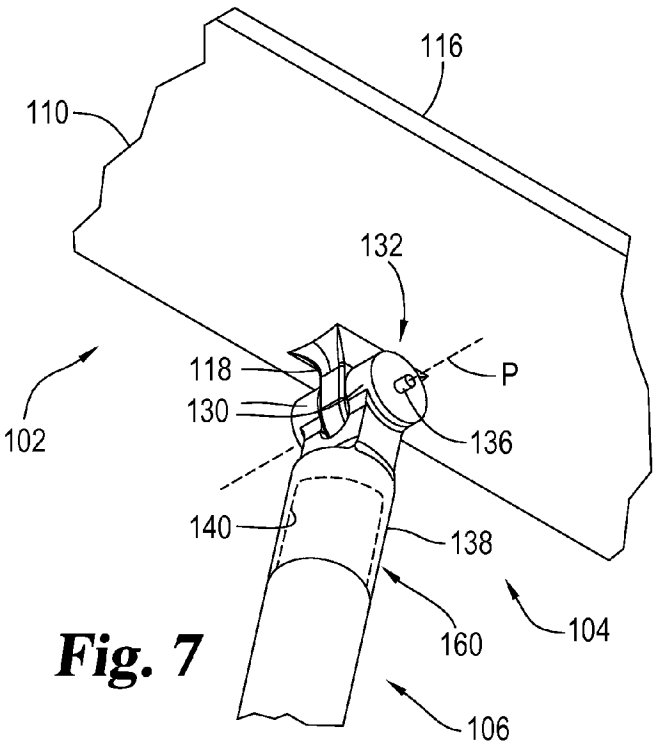
FIG. 7 is a close-up perspective view of the pole cleaning apparatus of FIG. 1.
Figure 6:
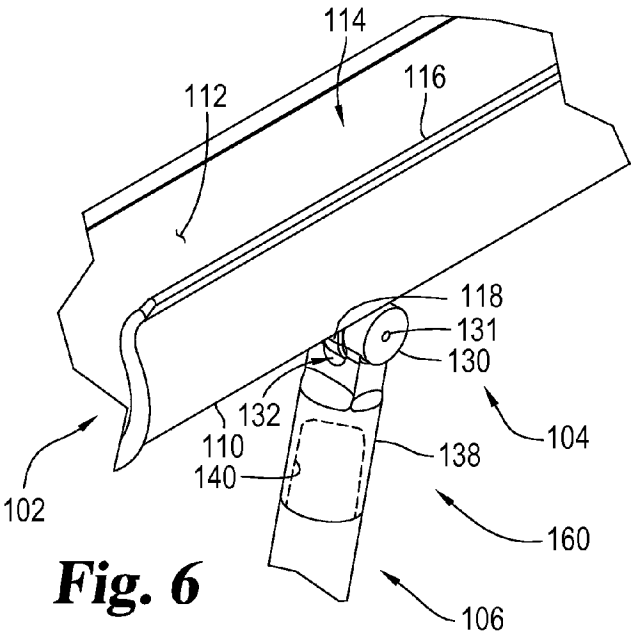
FIG. 6 is a close-up perspective view of the pole cleaning apparatus of FIG. 1.
Figure 8:
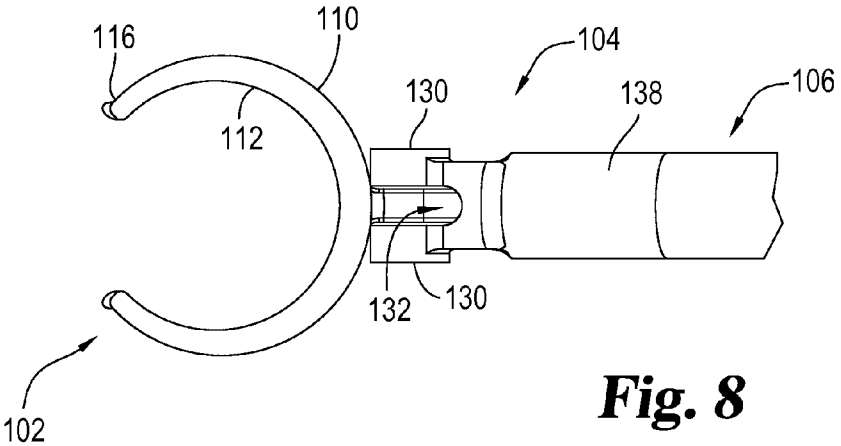
FIG. 8 is a close-up end view of the pole cleaning apparatus of FIG. 1.

As best shown in FIGS. 6-8, the particular illustrated example of mounting assembly 104 includes the alignment of mounting rings and the use of a pivot pin to secure the cleaning head 102 to the handle 106. As shown, cleaning head 102 includes a mounting ring 118 configured to engage with one or more components of the handle 106. The mounting ring 118 may be formed integrally with the tubular member 110 or may be a separate piece rigidly attached thereto. The illustrated mounting ring 118 defines a hole 120 extending therethrough and configured for receipt of a pivot pin 136 to allow for pivoting of the cleaning head 102 with respect to elongate handle 106. In the particular illustrated embodiment, the handle 106 includes a mounting piece defining two parallel side mounting rings 130 each defining a hole 131 extending therethrough and together defining an inner channel 132 into which mounting ring 118 is configured to be positioned. In such arrangements, the holes 131 are aligned with the hole 120 extending through ring 118, such that pivot pin 136 or a similar fastener may be positioned through the aligned holes to allow for pivoting of the cleaning head 102. It should be appreciated that the mounting assembly 104 may be configured in other appropriate manners so long as it pivotally engages the cleaning head 102 and the handle 106. As one non-limiting example, a mounting assembly including a pivot block and two perpendicular pivot pins to allow for pivoting in two directions may be used. Alternate examples of possible mounting arrangements are illustrated in FIGS. 9 and 10.

It should be understood that the pivoting arrangement between the cleaning head 102 and the handle 106 may be described with reference to the cleaning head 102 pivoting with respect to the handle 106, or the handle 106 pivoting with respect to the cleaning head 102. Both references are intended to generally describe the relative pivoting of the components. In the illustrated arrangement, the cleaning head 102 and/or the handle 106 is configured to pivot about a pivot axis P extending along the pivot pin 136 (see FIG. 7). It should be appreciated that the cleaning head 102 and/or the handle 106 may be configured to pivot in other manners or directions as would occur to one of ordinary skill in the art. For example, the mounting assembly 104 may be configured with an appropriate joint mechanism designed to allow for movement in multiple directions, such as through the use of a ball and socket joint, discussed in greater detail below with reference to FIG. 10. In alternative embodiments, the cleaning head 102 does not pivot with respect to the mounting assembly 104 and/or the handle 106, with a rigid connection occurring between the cleaning head 102 and the remaining components of the apparatus 100.

As mentioned above, FIGS. 9-10 illustrate embodiments of other example engagement and/or mounting configurations. With specific reference to FIG. 9, example pole cleaning apparatus 200 includes a mounting assembly 204 which is shaped differently than the mounting assembly 104 of apparatus 100. For example, assembly 204 includes non-rounded or substantially square-shaped side mounting wings 230. Additionally, assembly 204 includes a nut 237 to secure the pivot pin 236 and prevent inadvertent removal thereof. Additionally, FIG. 10 illustrates yet another example pole cleaning apparatus 300 having a mounting assembly 304 configured as a ball and socket joint to allow for pivoting in multiple directions. In the particular illustrated embodiment, cleaning head 302 includes a ball member 318 configured to engage with a socket member 330 to form ball and socket mounting assembly 304. The ball member 318 may be formed integrally with the cleaning head 302 or may be a separate piece rigidly attached thereto. Likewise, the socket member 330 may be formed integrally with the elongate handle 306 or may be a separate piece rigidly attached thereto. It should be appreciated that the mounting assembly 304 is shown in a minimalistic configuration for ease of illustration and may include additional features of typical ball and socket joint arrangements as would occur to one of ordinary skill in the art. Additionally, it is contemplated that components of apparatus 200 and/or 300 may be incorporated into apparatus 100, and vice versa.

In the illustrated embodiment shown in FIGS. 1-8, the mounting assembly 104 includes an engagement portion 138 to engage with the elongate handle 106. Engagement portion 138 may be integral with the rings 130, such that entire mounting assembly 104 consists of a single mounting piece. In other alternate embodiments, the engagement portion 138 may be a separate piece attached to or connected with the mounting rings 130 in an appropriate manner. As an example mounting method, the illustrated mounting portion 138 defines an interior hole or cavity 140 configured to receive a correspondingly sized engagement piece extending from the end of handle 106 (see FIGS. 6-7). In such embodiments, the elongate handle 106 may include an engagement end 160 configured with an extension piece designed to be received in the cavity 140 through a threaded engagement, snap fit engagement or other appropriate engagement mechanism. In alternative embodiments, the handle 106 may be an integral and continuous extension of the mounting assembly 104, such that it is not a separately engageable piece.

Handle 106 includes a free end 164 opposite the engagement end 160. In the illustrated embodiment, the free end 164 is rounded, however it should be appreciated that the free end 164 could be blunt or shaped in other manners. Additionally, the handle 106 may optionally include texturing, be manufactured from a gripping material or include an outer covering designed to assist with gripping of the apparatus 100 by a user during cleaning. In other optional embodiments, the handle may be configured in a telescoping manner or other appropriate manners designed to allow for selective extension of the handle 106 to enable the user to reach exceptionally high locations along the pole. For example, FIG. 12 illustrates an example telescoping handle 406 having a lower larger-diameter section **406*b* and an upper smaller-diameter section 406*a* designed to telescope in and out of section 406*b*. The telescoping arrangement of handle 106 may incorporate a push button pin 407 to lock the handle in position. In yet other optional embodiments, the handle 106 may be configured to bend or otherwise change its angular position to assist in pole cleaning and/or storage of the apparatus 100** during non-use.

Figure 11:
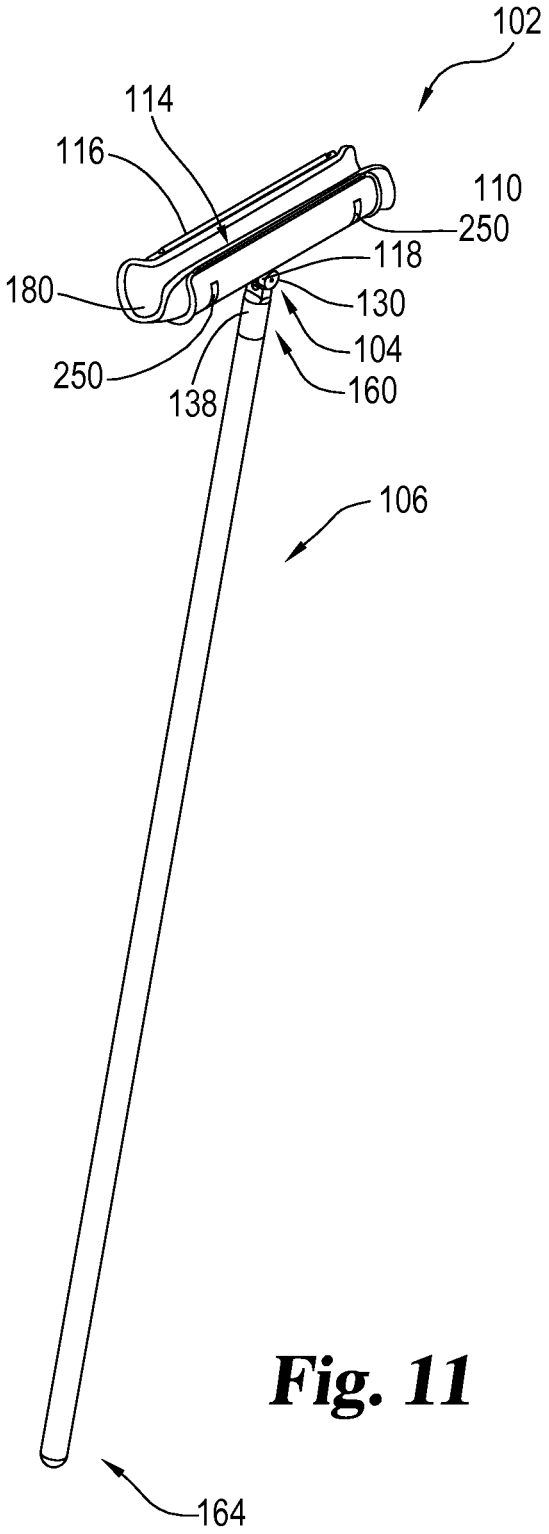
FIG. 11 is a perspective view of a pole cleaning apparatus according to another embodiment of the present disclosure.
Figure 12:
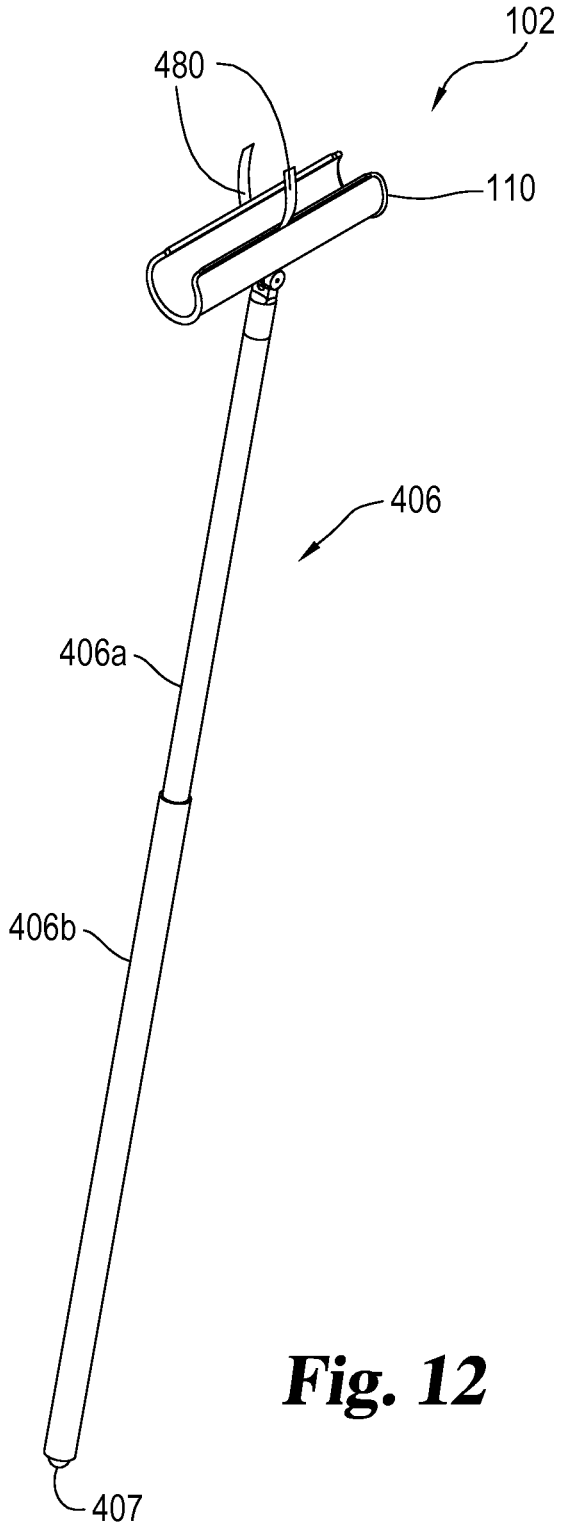
FIG. 12 is a perspective view of a pole cleaning apparatus according to another embodiment of the present disclosure.

FIG. 11 illustrates an optional embodiment in which a cleaning pad 180 may be selectively engaged with the tubular member 110 along inner arcuate surface 112 to assist with cleaning. The cleaning pad 180 may be impregnated with a cleaning preparation or alternately can be wet and/or dry to be used by itself or in combination with a separately-applied cleaning preparation. The pad 180 may be disposable, replaceable and/or reusable as would occur to one of ordinary skill in the art. In the particular embodiment illustrated in FIG. 11, pad 180 is positioned along the arcuate contact surface and wraps around the opposite side to engage with attachment sections 250 comprised of hook and loop fasteners. However, it should be appreciated that the pad 180 may be engaged with the tubular member in other appropriate manners, including but not-limited to through the use of adhesive, elastic (straps or the entire pad), friction fit, attachment straps, or fasteners, or the pad could also be configured as a sleeve to slide over and substantially cover the tubular member. In preferred embodiments, the pad extends beyond the edges of the tubular member such that the tubular member does not directly contact the pole in order to prevent scraping or other damage.

Use and operation of an example pole cleaning apparatus will now be discussed with respect to apparatus 100 illustrated in FIGS. 1-8. Use and operation of apparatuses 200 and 300 are the same or highly similar and will not be repeated for the sake of brevity. As discussed above, the apparatus 100 allows for the cleaning of poles, and for example vertical poles of significant height above the user's reach. The apparatus 100 is pressed against the pole to be cleaned and optionally secured in position, as discussed above. The user grips the handle 106 and moves the apparatus 100 longitudinally and circumferentially around the pole to clean it. The cleaning head 102 may be slid or otherwise moved up, down and around the pole. In this way, the cleaning head 102 engages at least a part of the circumference of the pole and is moved at least longitudinally, and in some embodiments also circumferentially, along the pole. As discussed above, in optional embodiments a cleaning pad 180 (see FIG. 11) may be selectively engaged with the tubular member 110 to assist with cleaning.

The figures provide example sizes and shapes for the components of apparatuses 100, 200 and 300. However, it should be appreciated that the apparatuses and various components may be sized and shaped differently as would occur to one of ordinary skill in the art. Further, it is contemplated that the apparatuses may include fewer than all of the example illustrated components shown in the accompanying figures, and/or may include additional suitable and/or necessary components not presently illustrated as would occur to one of ordinary skill in the art.

While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected.

What is claimed is:

1. A pole cleaning apparatus, comprising:

an elongate handle portion;

a cleaning head defining a longitudinal axis parallel to the pole; and a mounting assembly pivotably engaging the cleaning head to the handle portion, wherein the handle portion is pivotable with respect to the cleaning head in at least one plane containing the longitudinal axis;

wherein the cleaning head is configured to engage at least a portion of the circumference of the pole and be moved longitudinally along the pole;

wherein the cleaning head has a length extending along a longitudinal axis and a width, wherein the width of the cleaning head is shaped as a partial-tubular member having an opening extending along the longitudinal axis through which a pole may be passed to engage the cleaning head with the pole to be cleaned;

wherein the cleaning head includes two substantially parallel longitudinal edges extending along the longitudinal axis and defining an opening therebetween through which a pole may be passed to engage the cleaning head with the pole to be cleaned;

wherein the cleaning head includes an inner arcuate surface of constant radius extending from one of the longitudinal edges to the other of the longitudinal edges;

wherein the cleaning head includes a selective locking mechanism configured to retain the cleaning head against the pole to be cleaned.

2. The apparatus of claim 1, wherein the cleaning head is configured to substantially surround the circumference of the pole.

3. The apparatus of claim 1, wherein the width of the cleaning head is shaped as a partial-tubular member.

4. The apparatus of claim 1, wherein the handle portion is telescoping.

5. The apparatus of claim 1, wherein the mounting assembly includes a pivot pin configured to provide for pivoting of the handle portion about the pivot pin.

6. The apparatus of claim 1, wherein the mounting assembly is a ball and socket joint.

7. A pole cleaning apparatus, comprising:

an elongate handle portion;

a cleaning head having a length extending along a longitudinal axis and a width, wherein the width of the cleaning head is shaped as a partial-tubular member having an opening extending along the longitudinal axis through which a pole may be passed to engage the cleaning head with the pole to be cleaned, wherein the cleaning head includes parallel edges defining the opening therebetween and includes a single and continuous inner arcuate surface of constant radius extending between the parallel edges and configured to at least partially surround the pole to be cleaned, wherein the cleaning head is configured to be moved longitudinally along the pole for cleaning; and wherein the parallel edges are flared outward along the length of the inner arcuate surface; and a mounting assembly pivotably engaging the cleaning head to the handle portion, wherein the handle portion is pivotable with respect to the cleaning head in at least one plane containing the longitudinal axis.

8. The apparatus of claim 7, wherein the inner arcuate surface spans an arc of substantially 275 degrees and the opening spans an arc of substantially 85 degrees.

9. The apparatus of claim 7, wherein the cleaning head is made of a flexible material to allow for deflection during positioning of the cleaning head against the pole to be cleaned, wherein the cleaning head is biased to elastically return to a position at least partially surrounding the pole.

10. The apparatus of claim 7, wherein the cleaning head includes a selective locking mechanism configured to retain the cleaning head against the pole to be cleaned.

11. The apparatus of claim 7, wherein the handle portion is telescoping.

12. The apparatus of claim 7, further comprising a cleaning pad selectively engageable with the cleaning head along the inner arcuate surface to be positioned between the cleaning head and the pole to be cleaned.

13. The apparatus of claim 7, wherein the mounting assembly is non-pivotably engaged with the handle portion and includes two parallel mounting rings to pivotably engage the cleaning head, wherein the cleaning head includes a mounting ring configured to be positioned between the two parallel mounting rings of the mounting assembly, wherein the mounting assembly further includes a pivot pin configured to pivotably engage the mounting rings of the mounting assembly with the mounting ring of the cleaning head to provide for pivoting about the pivot pin.

14. The apparatus of claim 7, wherein the mounting assembly is a ball and socket joint.

15. A pole cleaning apparatus, comprising:

an elongate handle;

a cleaning head having a length extending along a longitudinal axis and a width, wherein the width of the cleaning head is shaped as a partial-tubular member having an opening extending along the longitudinal axis through which a pole may be passed to engage the cleaning head with the pole to be cleaned, wherein the cleaning head includes parallel edges defining the opening therebetween and includes a single and continuous inner arcuate surface of constant radius extending between the parallel edges and configured to at least partially surround the pole to be cleaned, wherein the cleaning head is configured to be moved longitudinally along the pole for cleaning; and a mounting assembly pivotably engaging the cleaning head to the handle, wherein the handle is pivotable with respect to the cleaning head in at least one plane containing the longitudinal axis;

wherein the cleaning head is made of a flexible material to allow for deflection during positioning of the cleaning head against the pole to be cleaned, wherein the cleaning head is biased to elastically return to a position at least partially surrounding the pole.

16. The apparatus of claim 15, wherein the mounting assembly is a ball and socket joint.

17. The apparatus of claim 15, wherein the cleaning head includes a selective locking mechanism configured to retain the cleaning head against the pole.

18. The apparatus of claim 15, wherein the handle is telescoping.

19. A pole cleaning apparatus, comprising:

an elongate handle portion;

a cleaning head having a length extending along a longitudinal axis and a width, wherein the width of the cleaning head is shaped as a partial-tubular member having an opening extending along the longitudinal axis through which a pole may be passed to engage the cleaning head with the pole to be cleaned, wherein the cleaning head includes parallel edges defining the opening therebetween and includes a single and continuous inner arcuate surface of constant radius extending between the parallel edges and configured to at least partially surround the pole to be cleaned, wherein the cleaning head is configured to be moved longitudinally along the pole for cleaning; and a mounting assembly pivotably engaging the cleaning head to the handle portion, wherein the handle portion is pivotable with respect to the cleaning head in at least one plane containing the longitudinal axis;

wherein the mounting assembly is non-pivotably engaged with the handle portion and includes two parallel mounting rings to pivotably engage the cleaning head, wherein the cleaning head includes a mounting ring configured to be positioned between the two parallel mounting rings of the mounting assembly, wherein the mounting assembly further includes a pivot pin configured to pivotably engage the mounting rings of the mounting assembly with the mounting ring of the cleaning head to provide for pivoting about the pivot pin.

* * * * *